US007381911B2

(12) United States Patent
Chou et al.

(10) Patent No.: US 7,381,911 B2
(45) Date of Patent: Jun. 3, 2008

(54) MULTI-INSTRUCTION SWITCH

(75) Inventors: Chin-Wen Chou, Taipei Hsien (TW); Hong-Yi Lee, Taipei Hsien (TW)

(73) Assignee: Zippy Technology Corp., Hsin-Tien, Taiwan Hsien (TW)

( * ) Notice: Subject to any disclaimer, the term of this patent is extended or adjusted under 35 U.S.C. 154(b) by 276 days.

(21) Appl. No.: 11/242,791

(22) Filed: Oct. 5, 2005

(65) Prior Publication Data

US 2007/0074960 A1 Apr. 5, 2007

(51) Int. Cl.
*H01H 9/00* (2006.01)

(52) U.S. Cl. ..... 200/4; 200/5 R; 200/11 R

(58) Field of Classification Search ..... 200/4, 200/5 A, 5 R, 6 A, 6 R, 11 A, 11 DA, 11 TW, 200/17 R, 18, 336, 564, 565, 570–574
See application file for complete search history.

(56) References Cited

U.S. PATENT DOCUMENTS 6,605,787 B1 * 8/2003 Chu ..... 200/11 G
6,642,459 B2 * 11/2003 Chou et al. ..... 200/11 TW
6,943,305 B2 * 9/2005 Kawamura et al. ..... 200/4
7,053,320 B2 * 5/2006 Kodo et al. ..... 200/17 R
7,067,744 B2 * 6/2006 Mere et al. ..... 200/4
7,145,087 B1 * 12/2006 Su et al. ..... 200/4
2006/0243568 A1 * 11/2006 Badarneh ..... 200/6 A

FOREIGN PATENT DOCUMENTS

TW 94116624 5/2005
TW 94117163 5/2005

* cited by examiner

*Primary Examiner*—Elvin Enad
*Assistant Examiner*—M. Fishman
(74) *Attorney, Agent, or Firm*—Muncy, Geissler, Olds & Lowe, PLLC

(57) ABSTRACT

A multi-instruction switch includes a base, a control disk, a plurality of electrodes and a conductive element. The control disk is located above the base and can rotate relative to the base to issue instructions. The conductive element is bent to form a common contact end in the middle portion and a first contact end and a second contact end on two ends to connect respectively to a common electrode, a first electrode and a second electrode. By rotating the control disk, a guiding portion located on an inner peripheral rim of the control disk can move the conductive element in a biased manner so that the common electrode and the first electrode or the second electrode are electrically connected to generate a leftward or rightward rotational instruction. Meanwhile a rotational click is produced. The structure is simple and the fabrication cost is lower.

12 Claims, 7 Drawing Sheets

MULTI-INSTRUCTION SWITCH

FIELD OF THE INVENTION

The present invention relates to a switch and particularly to a multi-instruction switch for generating a plurality of instructions.

BACKGROUND OF THE INVENTION

Multi-instruction switch is widely used now in various information appliances (IAs) such as mobile phones, Personal Digital Assistant (PDA), computer keyboards and the like. The multi-instruction switch can provide electric connection in multiple stages and generate a plurality circuit signals, hence a single switch can execute multiple actions to reduce the size of the information products. Utilization also is more convenient.

Applicant disclosed a multi-instruction switch of R.O.C. patent application No. 094116624 on May 23, 2005. It has a control disk to drive a first conductive element to rotate on an anchor member so that the first conductive element is connected to a contact on the anchor member to generate "rotational instructions". There is an anchor bar located in a trough of a guiding portion to generate a rotational click. A depressing element is provided to connect the contact to generate a click instruction.

However, the aforesaid technique cannot generate "directional introductions". Therefore, the Applicant further proposed a multi-direction instruction switch of R.O.C. patent application No. 094117163 on May 26, 2005. It has a first to fourth directional contacts on an anchor member to generate four "directional instructions", and a control disk with a depressible center to generate a "click instruction". The contacts for "rotational instructions" are located on one side of the anchor member to generate leftward and rightward rotational instructions. The switch thus formed can be made in a compact size to generate multiple instructions.

The present invention aims to expand the function of the rotational click of the anchor bar in the prior art so that the switch can generate multiple instructions at a smaller size.

SUMMARY OF THE INVENTION

The primary object of the present invention is to provide a multi-instruction switch to simplify instruction generation structure and also provide a rotational click.

To achieve the foregoing object, an embodiment of the multi-instruction switch of the invention includes a base, a control disk, a plurality of electrodes and a conductive element. The control disk is located above the base and can rotate relative to the base to issue instructions. The electrodes include a common electrode, a first electrode and a second electrode that are located on the base. The conductive element is bent to form a common contact end in the middle portion and a first contact end and a second contact end on two ends and is anchored on the base. The control disk has a guiding portion on an inner peripheral rim to drive the common contact end and move the conductive element during rotation. Hence the common electrode and the first electrode or second electrode are connected electrically to generate a leftward or rightward rotational instruction. In addition, the guiding portion has guiding ridges and guiding notches that are switchable on the common contact end to generate a rotational click during rotation.

Another object of the invention is to provide different methods for electric connection.

To achieve the foregoing object, the multi-instruction switch of the invention has the first contact end and second contact end connecting or not connecting to the first electrode and second electrode in normal conditions. By rotating the control disk so that the guiding portion drives the conductive element moving in a biased manner, the first contact end or the second contact end is moved away or in contact with the first electrode or the second electrode so that the common electrode is electrically connected to the first or second electrode.

The foregoing, as well as additional objects, features and advantages of the invention will be more readily apparent from the following detailed description, which proceeds with reference to the accompanying drawings.

DETAILED DESCRIPTION OF THE PREFERRED EMBODIMENTS

Figure 1:
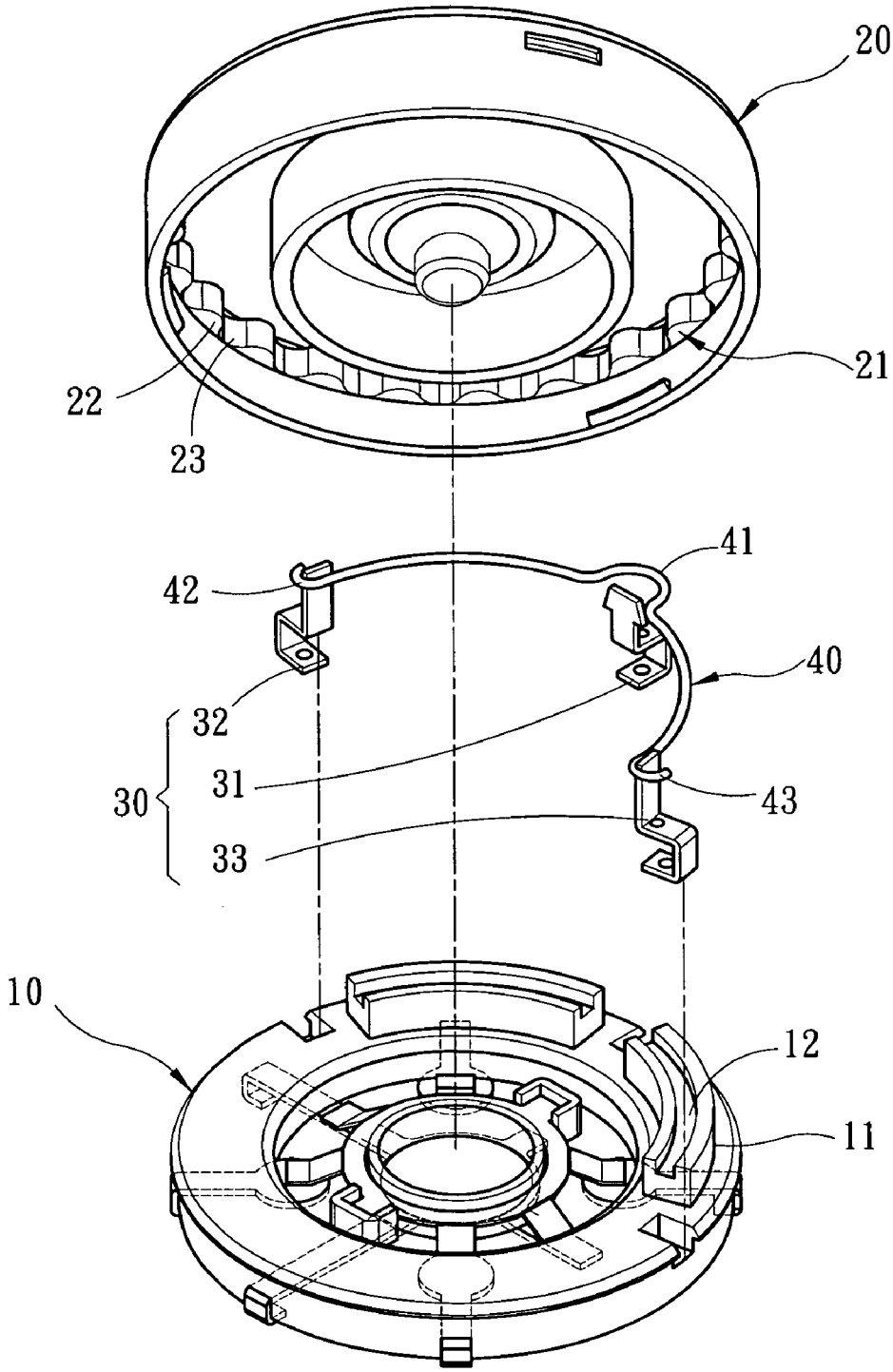
FIG. 1 is an exploded view of an embodiment of the multi-instruction switch of the present invention.

Please refer to FIG. 1 for an embodiment of the multi-instruction switch of the invention. It includes a base 10, a control disk 20, a plurality of electrodes 30 and a conductive element 40.

Figure 2:
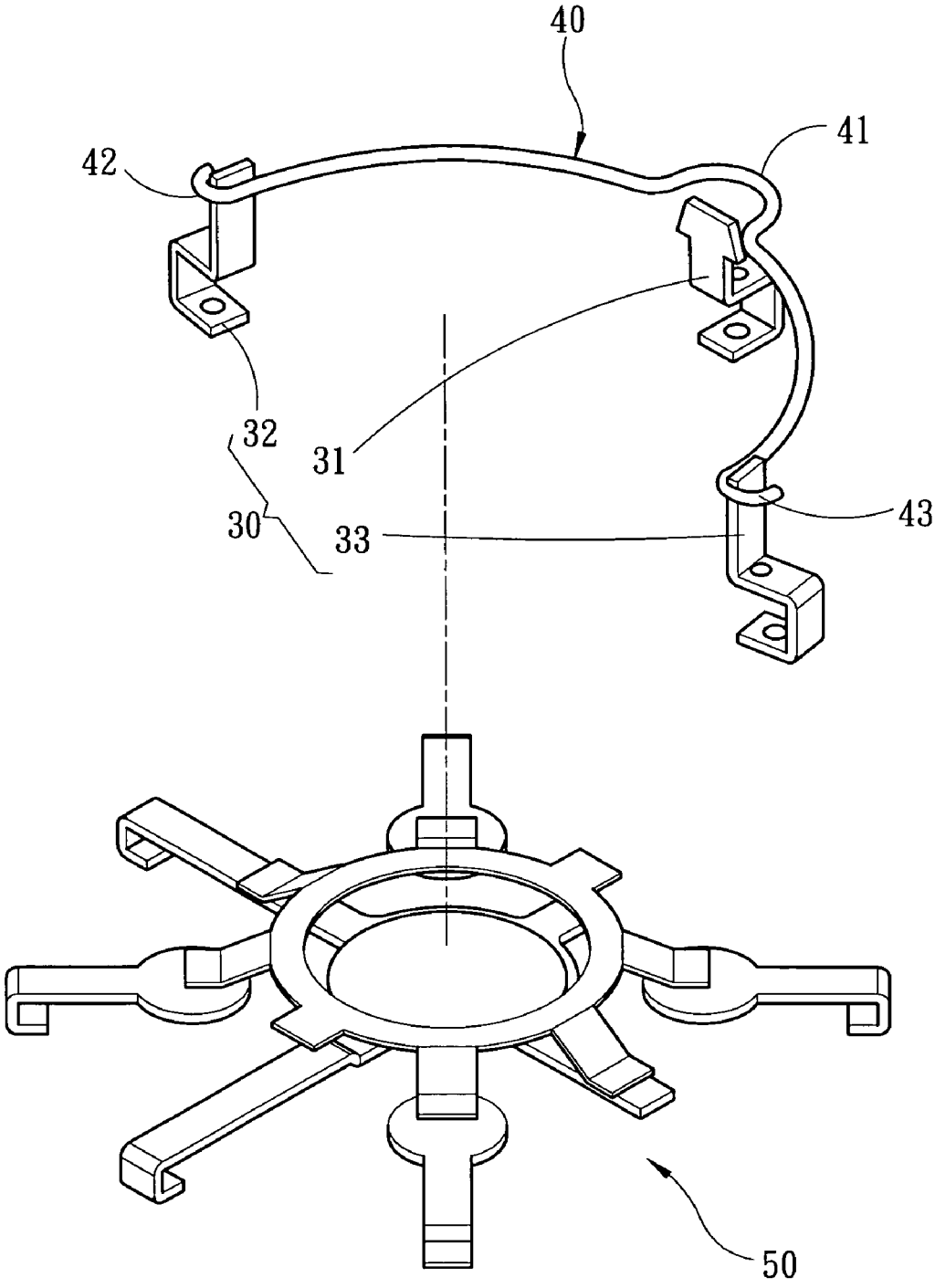
FIG. 2 is a fragmentary schematic view of an embodiment of the multi-instruction switch showing the internal electrodes and conductive element.

Also referring to FIG. 2, the base 10 contains a second instruction generator 50 to generate "click instructions" or "directional instructions" or their combination through the control disk 20 located above the base 10. The second instruction generator 50 is same as the one disclosed by the Applicant in R.O.C. patent application No. 094117163, details are omitted hereinafter. The second instruction generator 50 set forth above serves only for illustrative purpose, and is not the limitation of the invention.

The control disk 20 is located above the base 10 and can rotate relative to the base 10 to generate signals. In this embodiment, the control disk 20 has a guiding portion 21 on an inner peripheral rim corresponding to the perimeter of the base 10. The guiding portion 21 includes a plurality of consecutive guiding ridges 22 and guiding notches 23 that are alternately spaced from one another. When the control disk 20 rotates, the guiding ridges 22 and guiding notches 23 are moved to enable the multi-instruction switch to issue rotational instructions.

The electrodes 30 are located on the base 10, and include a common electrode 31, a first electrode 32 and a second electrode 33. In this embodiment, the common electrode 31 is electrically connected to the first electrode 32 or second electrode 33 through the conductive electrode 40 to generate a leftward or rightward rotation signal. The conductive element 40 is elastic and anchored on the base 10, and bent to form a common contact end 41 in the middle portion and a first contact end 42 and a second contact end 43 on two ends that are connected respectively to the common electrode 31, first electrode 32 and second electrode 33. The conductive element 40 is a semicircular arch. The drawing shows only an example and is not the limitation.

The conductive element 40 is anchored on the base 10 through an anchor member 11. In this embodiment, the anchor member 11 is fixedly located on the peripheral location of the base 10 without affecting depressing in the center and operation of the directional instructions. The anchor member 11 has a trough 12 mating the shape of the conductive element 40. Hence the conductive element 40 can slide slightly in the trough 12 while the guiding ridges 22 move the common contact end 41.

Figure 3A:
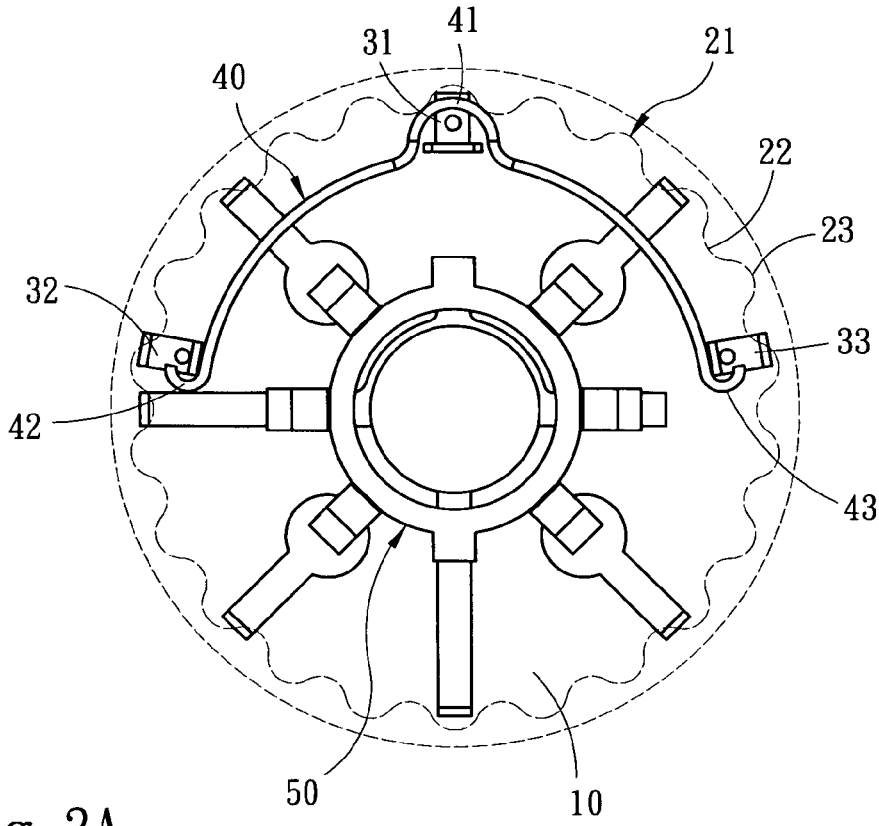
FIGS. 3A, 3B and 3C are schematic views of an embodiment of the multi-instruction switch in operating conditions.
Figure 3B:
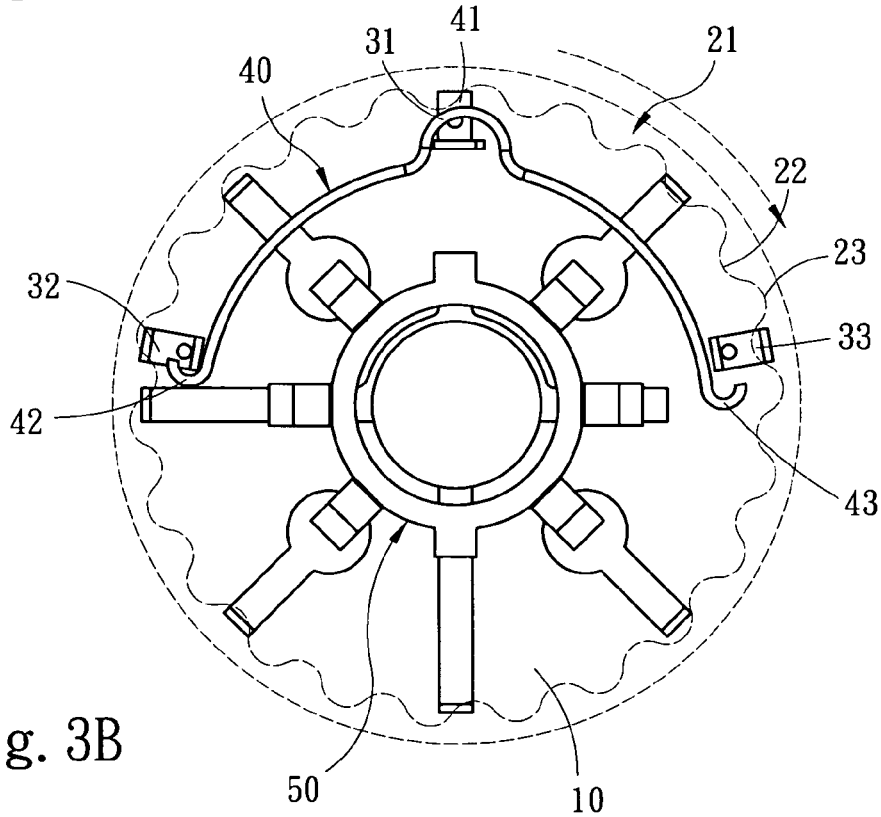
Figure 3C:
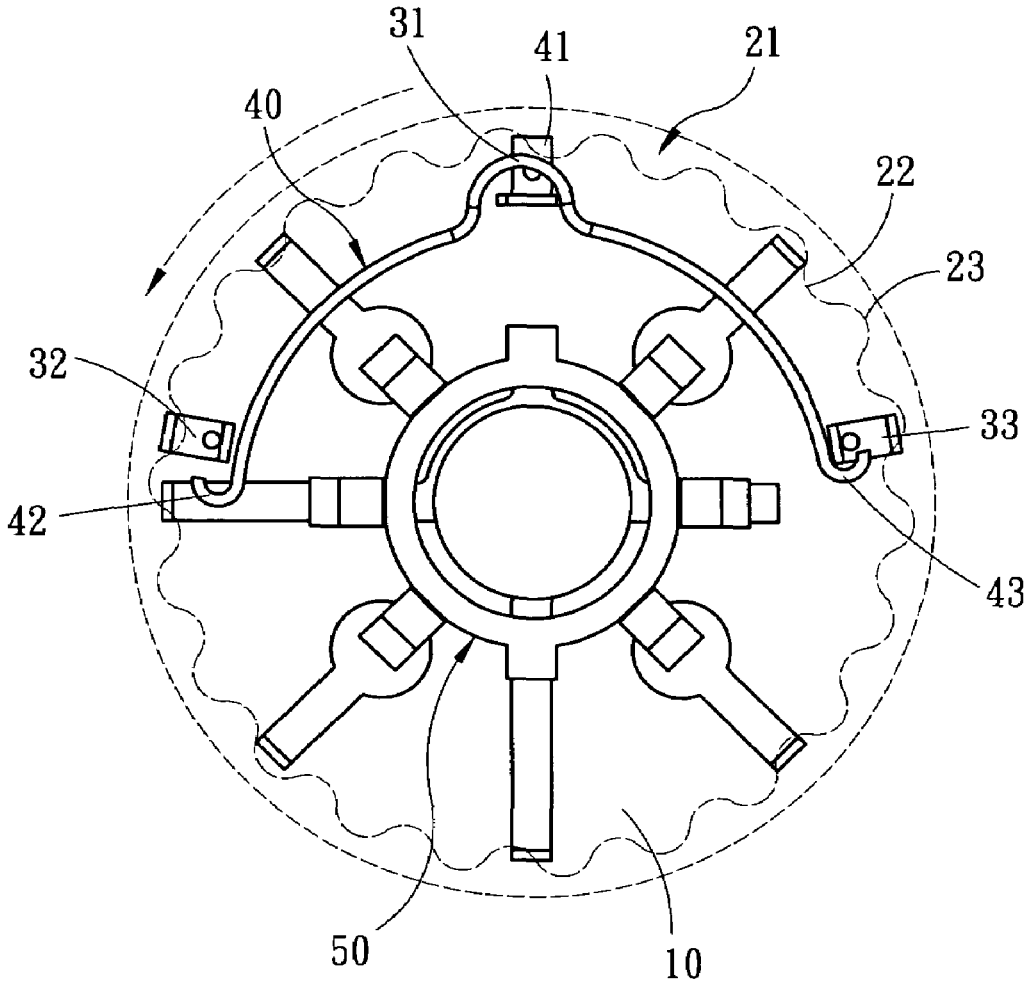

Referring to FIGS. 3A, 3B and 3C, when the embodiment is in use, in normal conditions, the common contact end 41 is located in the trough 23 of the control disk 20 without connecting to the common electrode 31, and the first and second contact ends 42 and 43 are connected respectively to the first electrode 32 and the second electrode 33 (referring to FIG. 3A). When a user rotates the control disk 20, the guiding ridges 22 move the conductive element 40 in a biased manner, the common contact end 41 is connected to the common electrode 31, while the first contact end 42 or second contact end 43 is moved away from the first electrode 32 (referring to FIG. 3C) or the second electrode 33 (referring to FIG. 3B) due to rotation of the control disk 20. Thereby the control disk 20 which rotates leftwards or rightwards electrically connects the common electrode 31 with the second electrode 33 or the first electrode 32 to issue a leftward or rightward rotational instruction. When the guiding ridges 22 do not move the common contact end 41, the conductive element 40 returns to its original position in the normal conditions due to its elasticity (referring to FIG. 3A) without issuing any instruction.

In this embodiment, the conductive element 40 not only can provide electric connection, its common contact end 41 can slide over the guiding notches 23 while the control disk 20 rotates and a click can be generated through the guiding ridges 22. Thus when the user performs rotating operation, a click is generated to facilitate sensing of the rotational position. Moreover, the control disk 20 may have directional marks carved on the upper side to enable users to accurately issue instructions without making errors.

Figure 4:
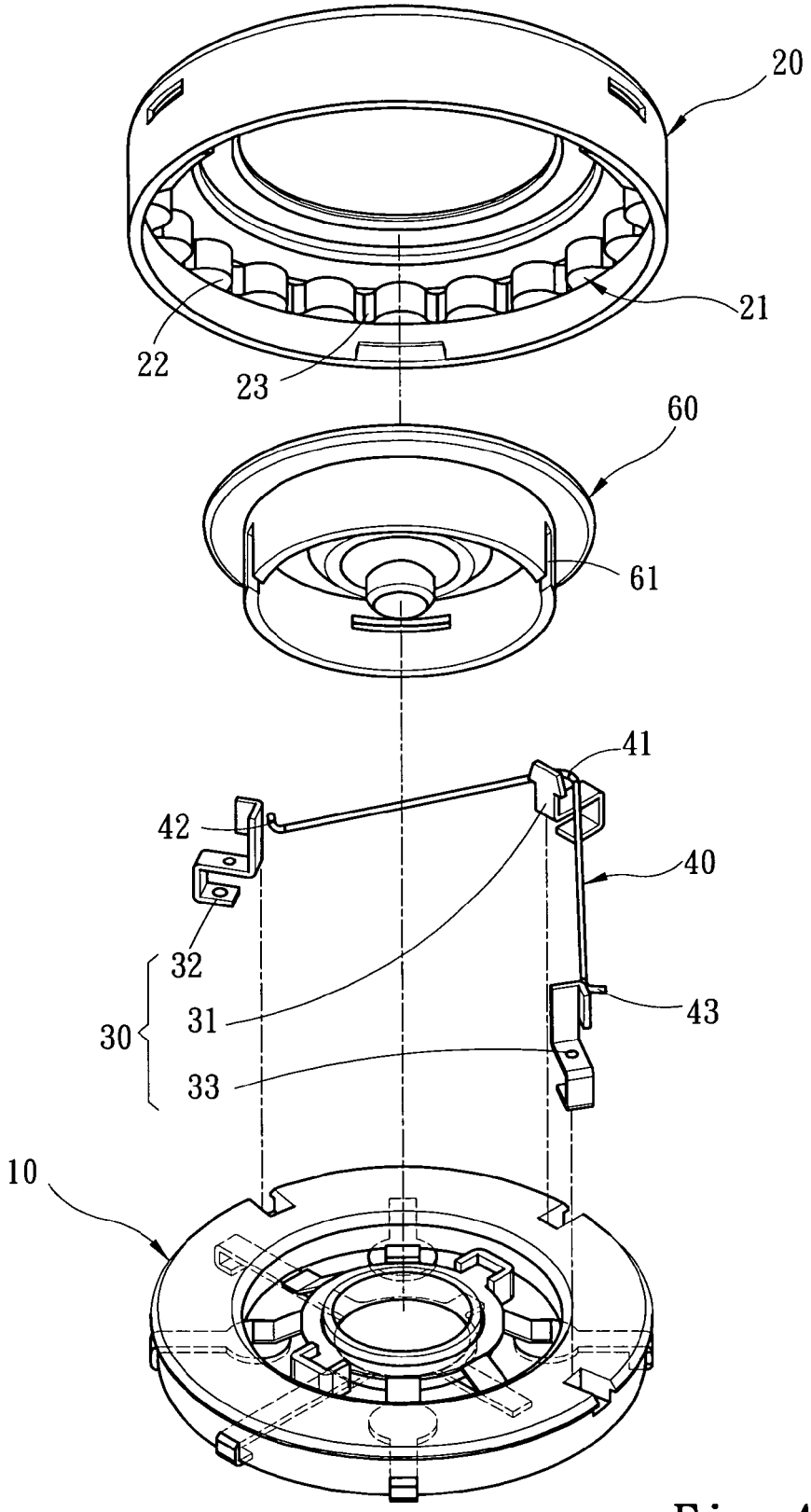
FIG. 4 is an exploded view of another embodiment of the multi-instruction switch of the present invention.

Referring to FIG. 4, another embodiment of the invention aims to provide a different electric connection method. The conductive element 40 is anchored on the base 10 by wedging in a plurality of slits 61 formed on a shell 60. The shell 60 does not rotate with the control disk 20. The conductive element 40 is confined in the shell 60. The common contact end 41, first contact end 42 and second contact end 43 are exposed outside of the slits 61. Hence each contact end can be moved slightly in the slit 61 when the common contact end 41 is moved by the guiding ridges 22. The shell 60 may be coupled with the control disk 20 to become an integrated body.

Figure 5A:
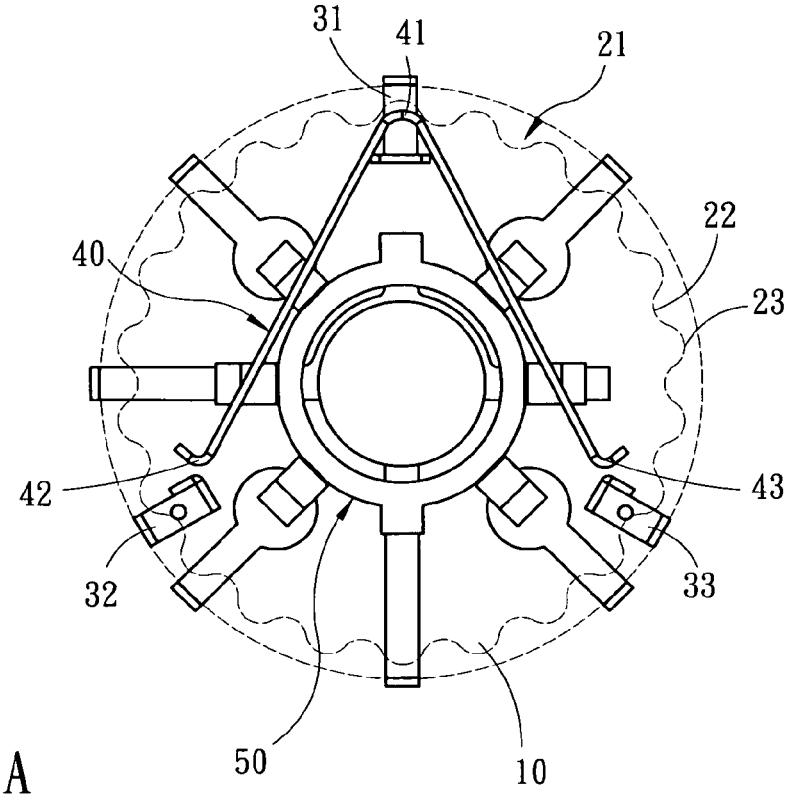
FIGS. 5A, 5B and 5C are schematic views of another embodiment of the multi-instruction switch in operating conditions.
Figure 5B:
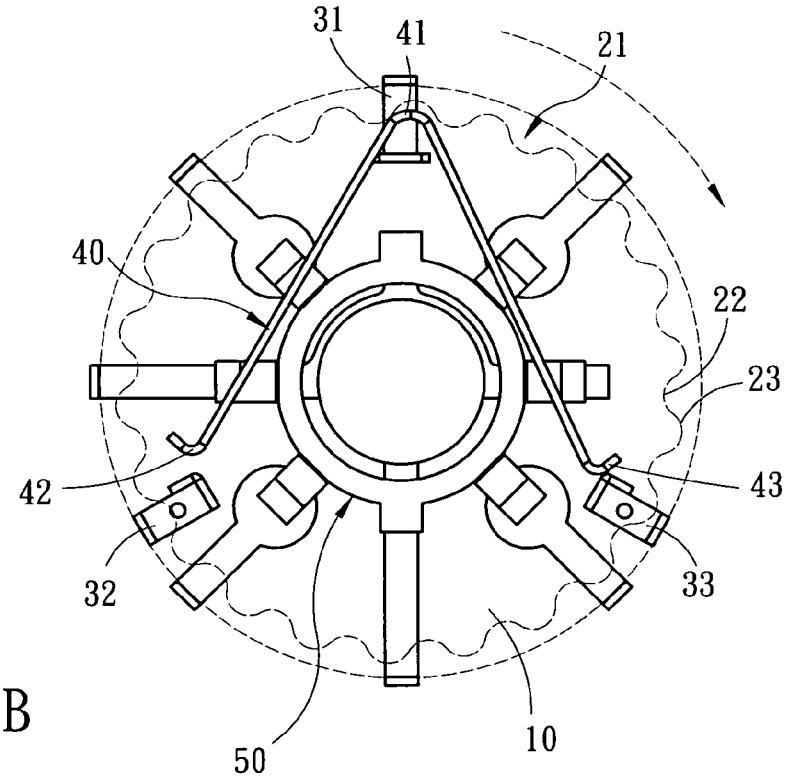
Figure 5C:
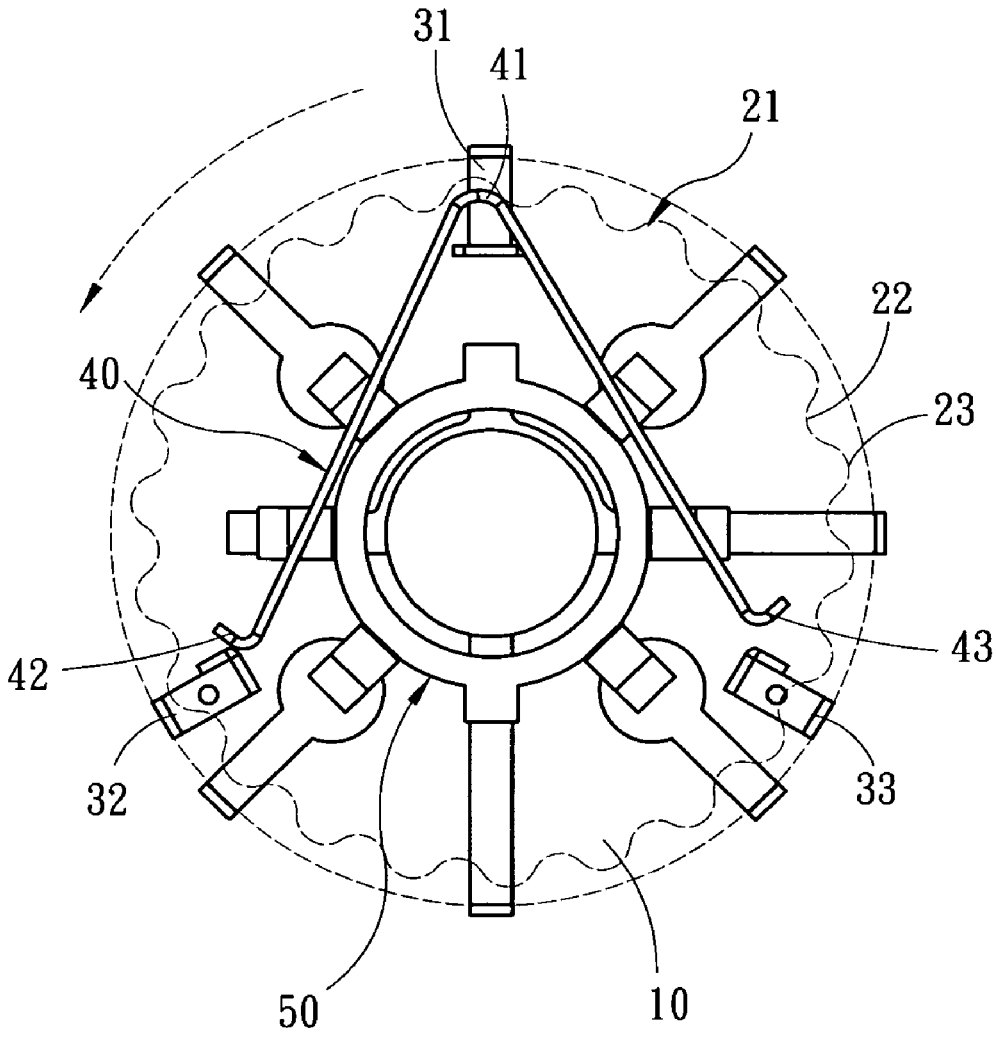

Referring to FIGS. 5A, 5B and 5C, when in use, in normal conditions, the common contact end 41 is located in the guiding trough 23 and is either connected or not connected to the common electrode 31. The first contact end 42 and second contact end 43 are not connected to the first electrode 32 and the second electrode 33 (referring to FIG. 5A). When a user rotates the control disk 20 and the guiding ridges 22 drive the common contact end 41 to move the conductive element 40 in a biased manner, the common contact end 41 is connected to the common electrode 31 or maintains in the original connecting condition. The first contact end 42 or second contact end 43 is connected to the first electrode 32 (referring to FIG. 5C), or the second electrode 33 (referring to FIG. 5B) due to rotation of the control disk 20. Thereby, by rotating the control disk 20 leftwards or rightwards, the common electrode 31 is electrically connected to the first electrode 32 or the second electrode 33 to issue a leftward or rightward rotational instruction. When the guiding ridge 22 does not move the common contact end 41, the conductive element 40 returns to its original position in the normal conditions due to its elasticity (referring to FIG. 5A) without issuing any instruction.

In short, the multi-instruction switch of the invention includes the conductive element 40 and a plurality of electrodes 30. The control disk 20 can be rotated by users so that the guiding portion 21 can move the conductive element 40 to electrically connect the common electrode 31 to either the first electrode 32 or the second electrode 33. Not only a leftward or rightward rotational signal can be generated, a rotational click can also be produced. The switch thus formed has a simple structure and can be made at a smaller size. Fabrication cost also is lower.

While the preferred embodiments of the invention have been set forth for the purpose of disclosure, modifications of the disclosed embodiments of the invention as well as other embodiments thereof may occur to those skilled in the art. Accordingly, the appended claims are intended to cover all embodiments which do not depart from the spirit and scope of the invention.

What is claimed is:

1. A multi-instruction switch, comprising:

a base;

a control disk located above the base and turnable relative to the base having a guiding portion on an inner peripheral rim corresponding to the perimeter of the base;

a plurality of electrodes located on the base including a common electrode, a first electrode and a second electrode; and a conductive element which is elastic and anchored on the base and bent to form a common contact end in a middle portion and a first contact end and a second contact end on two ends, the common contact end being not connected to the common electrode in normal conditions, and the first contact end and the second contact end being connected respectively to the first electrode and the second electrode; the control disk being turnable leftwards or rightwards so that the guiding portion drives the common contact end to connect the common electrode, and the conductive element is moved in a biased manner such that the first contact end or the second contact end is separated from the first electrode or the second electrode, and the common electrode is electrically connected to the second electrode or the first electrode.

2. The multi-instruction switch of claim 1, wherein the conductive element is anchored on the base through an anchor member.

3. The multi-instruction switch of claim 2, wherein the anchor member is fixedly located on the base and has a trough, the conductive element being held in the trough and able to slide slightly therein by moving of the guiding portion.

4. The multi-instruction switch of claim 1, wherein the conductive element is anchored on the base through a shell which has a plurality of slits, the shell being not moved with the control disk, the conductive element being confined in the shell, the common contact end, the first contact end and the second contact end being exposed outside the slits and able to slide slightly in the slits by moving of the guiding portion.

5. The multi-instruction switch of claim 4, wherein the shell and the control disk are coupled together to form an integrated body.

6. The multi-instruction switch of claim 1, wherein the guiding portion includes a plurality of consecutive guiding ridges and guiding notches that are alternately spaced from one another, the common contact end being located in the guiding notches in the normal conditions, the turning of the control disk moving the common contact end through the guiding ridges.

7. A multi-instruction switch, comprising:

a base;

a control disk located above the base and turnable relative to the base having a guiding portion on an inner peripheral rim corresponding to the perimeter of the base;

a plurality of electrodes located on the base including a common electrode, a first electrode and a second electrode; and a conductive element which is elastic and anchored on the base and bent to form a common contact end in a middle portion and a first contact end and a second contact end on two ends, the common contact end being connected or not connected to the common electrode in normal conditions, and the first contact end and the second contact end being not connected respectively to the first electrode and the second electrode; the control disk being turnable leftwards or rightwards so that the guiding portion drives the common contact end to connect the common electrode, and the conductive element is moved in a biased manner such that the first contact end or the second contact end is connected to the first electrode or the second electrode, and the common electrode is electrically connected to the first electrode or the second electrode.

8. The multi-instruction switch of claim 7, wherein the conductive element is anchored on the base through an anchor member.

9. The multi-instruction switch of claim 8, wherein the anchor member is fixedly located on the base and has a trough, the conductive element being held in the trough and able to slide slightly therein by moving of the guiding portion.

10. The multi-instruction switch of claim 7, wherein the conductive element is anchored on the base through a shell which has a plurality of slits, the shell being not moved with the control disk, the conductive element being confined in the shell, the common contact end, the first contact end and the second contact end being exposed outside the slits and able to slide slightly in the slits by moving of the guiding portion.

11. The multi-instruction switch of claim 10, wherein the shell and the control disk are coupled together to form an integrated body.

12. The multi-instruction switch of claim 7, wherein the guiding portion includes a plurality of consecutive guiding ridges and guiding notches that are alternately spaced from one another, the common contact end being located in the guiding notches in the normal conditions, the turning of the control disk moving the common contact end through the guiding ridges.

* * * * *